United States Patent [19]

Doxey et al.

[11] Patent Number: 4,817,235

[45] Date of Patent: Apr. 4, 1989

[54] PNEUMATIC PAVEMENT CLEANING APPARATUS

[76] Inventors: Tom R. Doxey, 2101 Constellation Dr., Colorado Springs, Colo. 80906; Burton D. Glaser, 723 Prairie Rd., Colorado Springs, Colo. 80909

[21] Appl. No.: 159,979

[22] Filed: Feb. 24, 1988

[51] Int. Cl.[4] ..... A47L 5/30

[52] U.S. Cl. ..... 15/387; 15/383

[58] Field of Search ..... 15/383, 387

[56] References Cited

U.S. PATENT DOCUMENTS

| | | | |
|---|---|---|---|
| 1,423,844 | 7/1922 | Fenelon | 15/387 X |
| 2,331,692 | 10/1943 | Hunt | 15/387 |
| 2,489,399 | 11/1949 | Claytor | 15/387 |
| 2,872,708 | 2/1959 | Jeppson et al. | 15/387 X |

FOREIGN PATENT DOCUMENTS

| | | | |
|---|---|---|---|
| 1015949 | 1/1966 | United Kingdom | 15/387 |

*Primary Examiner*—Chris K. Moore

*Attorney, Agent, or Firm*—Henderson & Sturm

[57] ABSTRACT

A pneumatic pavement cleaning apparatus (10) comprising: an air supply unit (11); a wheeled support unit (12); a drive unit (13) including an air powered motor (25); and a cleaning unit (14) operatively associated with the drive unit (13); wherein, a plurality of diverse cleaning attachment members (31) including a brush element (32) and a blade element (33) may be selectively secured to the axial drive shaft (27) of the drive unit (13).

2 Claims, 1 Drawing Sheet

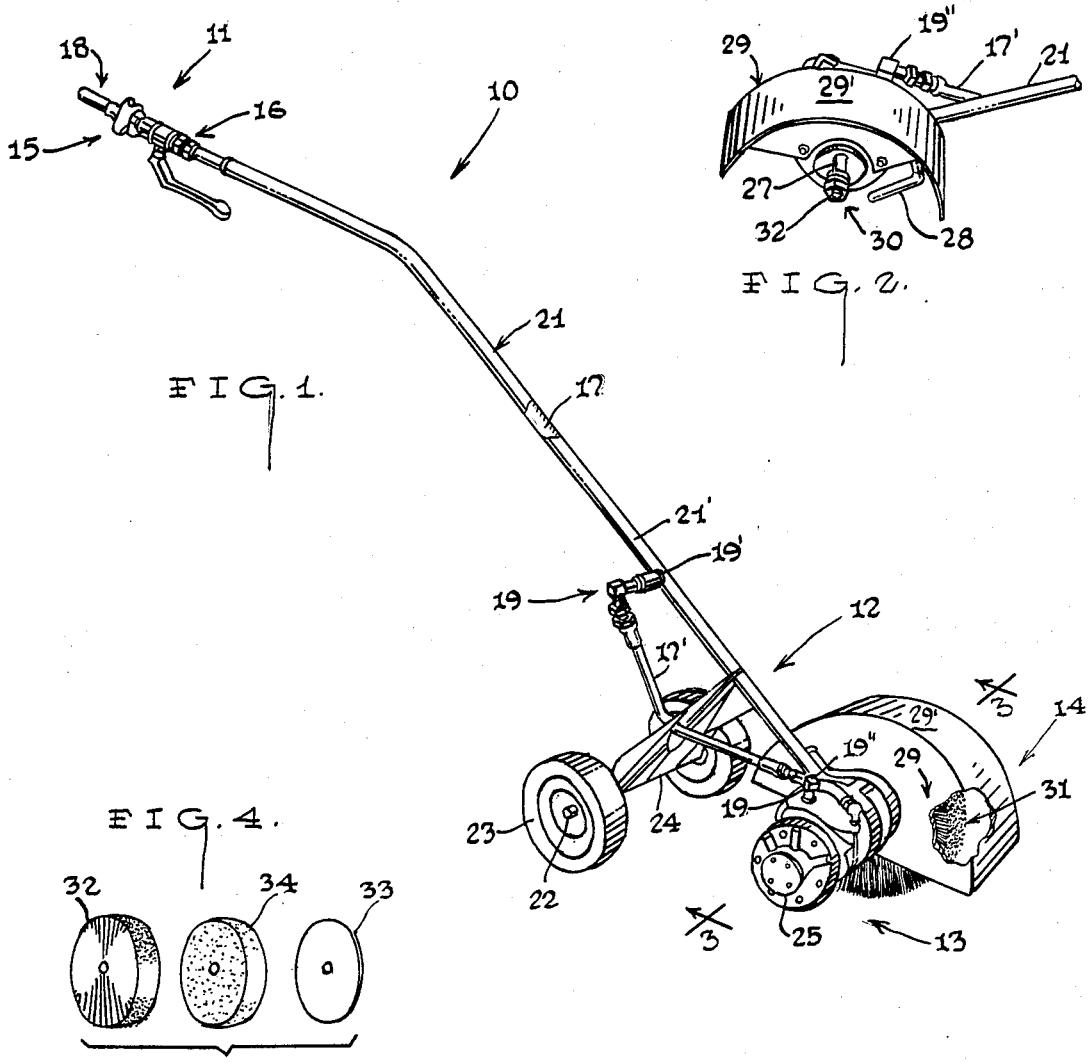
FIG. 1.
FIG. 2.
FIG. 4.
FIG. 3.
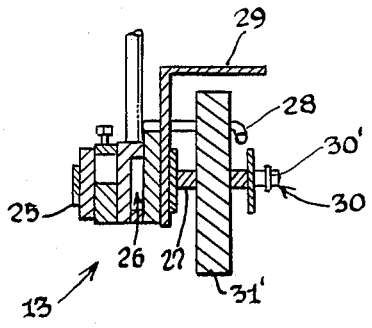

PNEUMATIC PAVEMENT CLEANING APPARATUS

TECHNICAL FIELD

The present invention relates generally to pavement cleaning devices, and in particular to a pneumatically operated pavement cleaning apparatus.

BACKGROUND OF THE INVENTION

As can be seen by reference to the following U.S. Pat. Nos. 4,594,749; 4,300,261; 4,144,615; and 3,636,585 the prior art is replete with myriad and diverse pneumatically assisted cleaning devices.

While the prior art constructions are more than adequate for the purpose and function for which they were specifically designed, they are limited in the number of different tasks that they are capable of performing, plus they uniformly employ complicated drive mechanisms to provide the motorized operation of the respective devices.

In addition, in those cleaning devices that are specifically dedicated to pavement maintenance, these structures fail to provide for, or even contemplate adapters that can be used for not only brushing applications, but other tasks, such as grinding or cutting as needed.

Furthermore, the prior art constructions generally employ a complicated drive mechanism having a large number of cooperating structural components; wherein, the failure of one of the moving parts usually renders the entire mechanism inoperative.

It has also become evident to those familiar with the prior art constructions that for ease in operating a pavement cleaning device; the particular apparatus should be of an easily manageable size to allow controlled operation by a single person.

Obviously, there has been a longstanding need for a pavement maintenance device which incorporates the features of versatility, simplicity, and manageability; and, the development of such a device is the stated purpose and objective of the present invention.

BRIEF SUMMARY OF THE INVENTION

The pavement maintenance apparatus that forms the basis of the present invention comprises in general: an air supply unit, a movable support unit, a drive unit, and a cleaning unit. The air supply unit comprises in general: a primary coupling member, a valve member, a supply tube member, and a hose member; wherein, the hose member is provided with a pair of secondary coupling members. The primary coupling member is adapted to receive air from an external source of compressed air and allow the pressurized air to be transferred to the supply tube member; wherein, the valve member will control the flow of air to operate the apparatus.

The movable support unit comprises in general: a pair of wheel members, an axle member and a support member; wherein, the support member is attached to the air supply unit in a fashion to keep it in a generally upright orientation; and wherein, the support member includes an axle bearing member so that the support member may rest on the axle which in turn rests on the wheels, which are disposed at opposite ends of the axle.

The drive unit comprises in general: a motor member and a releasable attachment member. The motor member comprises in general: an air powered motor which rotates the axle. The releasable attachment member disposed on the free end of the axle which is driven in a controlled manner by the motor; which receives compressed air from the hose member and secondary coupling members of the air supply unit.

The cleaning unit comprises in general: a blower tube member, removable attachment members and a protective cowl member; wherein, the diverse attachment elements may be attached to the axle of the drive unit.

BRIEF DESCRIPTION OF THE DRAWINGS

These and other objects, advantages, and novel features of the invention will become apparent from the detailed description of the best mode for carrying out the preferred embodiment of this invention which follows, particularly when considered in conjunction with the accompanying drawings, wherein:

FIG. 1 is a perspective view of the apparatus employing the brush attachment member of this invention;

FIG. 2 is a perspective view of the removable attachment means of this apparatus which accommodates the various attachment members;

FIG. 3 is a cross-sectional view of the operative engagement between one of the attachment members and drive unit of the apparatus; and, FIG. 4 is an exploded perspective view of the diverse attachment members contemplated for use with the apparatus.

BEST MODE FOR CARRYING OUT THE INVENTION

As can be seen by reference to the drawings and in particular to FIG. 1, the pneumatic pavement maintenance apparatus that forms the basis of the present invention is designated generally by the reference numeral (10). The pneumatic pavement maintenance apparatus (10) comprises in general: an air supply unit (11); a wheeled support unit (12); a drive unit (13); and, a cleaning unit (14). These units will now be described in seriatim fashion.

As can best be seen by reference to FIG. 1, the air supply unit (11) comprises in general: a primary air coupling member (15); a valve member (16); an air supply tube member (17); an air hose member (18); a pair of secondary coupling members (19); and a source of compressed air (20) (not shown). The air hose member (18) operatively connects the supply of compressed air (20) to the primary air coupling member (15); wherein, the valve member (16) controls the feeding supply of the compressed air through the remainder of the air supply unit (11) in a well recognized manner. The downstream side of the valve member (16) is connected to the air supply tube member (17); wherein, the secondary coupling members (19) operatively connect the source of compressed gas (20) to the drive unit (13) in a manner that will be described presently.

Still referring to FIG. 1, it can be seen that the support unit (12) comprises in general: an elongated tubular shaft member (21); an axle member (22); a pair of wheel members (23); and, an apertured support plate unit (24). The upper end of the elongated tubular shaft member (21) comprises a rigid hollow housing element (21') which contains the air supply tube (17) wherein the first (19') of the secondary coupling members (19) is operatively connected to the air supply tube (17) through the wall of the tubular shaft member (21); and, wherein the lower end of the rigid tubular shaft member (21) is operatively connected to the drive shaft unit (13) of the apparatus (10).

In addition, the wheel members (23) of the support unit (12) are operatively connected to the axle member (22) in a well recognized fashion; and the apertured support plate (24) in a well recognized fashion; and the apertured support plate (24) is operatively disposed between the wheel and axle assembly (22, 23) and the rigid tubular shaft member (21), such that the shaft member (21) is suspended and supported above the axle (22).

Furthermore, the lower portion (17') of the air supply tube (17) extends through the aperture (24') of the apertured support plate (24) and between the first (19') and second (19'') of the secondary coupling members (19); wherein, the outlet end of the air supply tube (17) terminates in the second (19'') of the secondary coupling members (19) which is also operatively connected to the drive unit (13).

As can be seen by reference to FIGS. 1 thru 3, the drive unit (13) comprises an air powered motor member (25) having an impellor chamber (26) whose output is transmitted to an axial drive shaft (27) in a well recognized manner. As mentioned previously in the specification the lower end of the tubular support shaft member (21) is rigidly secured to the housing (25') of the air powered motor member (25) to provide support thereto; and, the second (19'') of the secondary coupling (19) is also operatively connected to the interior of the impellor chamber (26) to allow the valve (16) controlled flow of compressed air into the chamber (26) to impart rotary movement to the axial drive shaft (27).

As shown in FIGS. 2 thru 4, the cleaning unit (14) comprises: a blower tube member (28); a cowl member (29); a securing member (30); and, diverse cleaning attachment members (31), all of which are operatively associated with the drive unit (13). The cowl member (29) extends outwardly from the air powered motor member (25) wherein the cowl shroud (29') is at least partially radially disposed relative to the axial drive shaft (27) of the motor (25). In addition, the blower tube member (28) is operatively connected to the outlet of the impellor chamber (26) and disposed relative to the cowl member (29); such that the compressed air exhausted from the impellor chamber (26) may be selectively directed within the cowl member (29).

As can best be seen by reference to FIGS. 2 and 3, the securing member (30) of the cleaning unit (14) comprises a threaded nut (30') that cooperates with the complimentary threaded end of the drive shaft (27) to releasably secure diverse cleaning attachment members (31) to the drive unit (13).

As shown in FIG. 4, the diverse cleaning attachment members (31) comprise: a brush element (32); a blade element (33) and a grinding wheel element (34); wherein, all of the cleaning attachment members (31) are provided with a central aperture (35) which is adapted to receive the axial drive shaft (27) and be releasably secured thereon in an operative disposition by the engagement of the securing member (30) with the outboard end of the drive shaft (27).

At this juncture it should be appreciated that a pneumatic pavement maintenance apparatus (10) built in accordance with the teachings of this invention is capable of both the sequential sweeping and trimming of a pavement surface as well as possessing the capability of resharpening the edges of the trimming cutting blade element (33) by applying the edges of the cutting blade element (33) to the periphery of the grinding wheel element (34) when the grinding wheel element (34) is operatively deployed on the apparatus (10).

In addition, not only is the aforementioned apparatus (10) substantially lighter, cleaner and quieter than similar combustion driven devices of this type; but, another added advantage of the apparatus of this invention is the fact that the exhaust air from the present apparatus (10) is directed to a useful purpose; in that it will blow clippings and other debris off to one side of the direction of travel of the apparatus (10) to further facilitate the cleaning objective of the apparatus.

Having thereby described the subject matter of this invention it should be apparent that many substitutions, modifications, and variations of the invention are possible in light of the above teachings. It is therefore to be understood that the invention as taught and described herein is only to be limited to the extent of the breadth and scope of the appended claims.

We claim:

1. A pneumatic pavement cleaning apparatus consisting of:

an air supply unit including a source of compressed air; an air supply hose member connected to the source of compressed air; a valve member connected on end to the air hose member and provided on its other end with an air supply tube member; wherein, the valve member controls the flow of air from the source of compressed air to the outlet end of the air supply tube member;

a wheeled support unit operatively associated with said air supply tube member;

a drive unit having an axial drive shaft wherein the drive unit comprises an air powered motor member having an inlet and an outlet wherein the drive unit is operatively connected to the outlet end of the air supply tube member whereby the controlled admission of compressed air through said valve member and said air supply tube member will cause the motor member to rotate said axial drive shaft; and, a cleaning unit operatively associated with said drive inlet for use with a selected one among a plurality of diverse cleaning attachment members including a brush element; and a cutting blade member; and, a securing member for releasably securing said selected one of said plurality of cleaning attachment members to the outboard end of said axial drive shaft; a cowl member operatively connected to said drive unit and radially disposed relative to the axial drive shaft of the drive unit; and, a blower tube unit operatively connected to the outlet of the air powered motor member whereby the exhaust from the said motor member may be discharged to one side and at an angle relative to one side of the selected one of said plurality of cleaning attachment members disposed within the cowl member of the cleaning unit; wherein said blower tube unit will blow debris off to one side of the direction of travel of the apparatus.

2. The apparatus as in claim 1, wherein said plurality of diverse cleaning attachment members further comprise:

a grinding wheel element.

* * * * *